US007191581B1

(12) United States Patent
Nettles

(10) Patent No.: US 7,191,581 B1
(45) Date of Patent: Mar. 20, 2007

(54) SADDLE TREE AND METHOD OF CONSTRUCTION FOR EXERCISE SADDLE

(76) Inventor: L. Ronnie Nettles, 1087 Nettles La., Madisonville, TX (US) 77864

( * ) Notice: Subject to any disclaimer, the term of this patent is extended or adjusted under 35 U.S.C. 154(b) by 0 days.

(21) Appl. No.: 11/321,180

(22) Filed: Dec. 29, 2005

(51) Int. Cl.
*B68C 1/02* (2006.01)

(52) U.S. Cl. ..... 54/44.1; 54/38.1; 54/44.7

(58) Field of Classification Search ..... 54/38.1, 54/44.1–44.7, 37.1, 39.1, 40.1, 41.1, 42.1, 54/43.1, 45.1, 46.1, 46.2, 1
See application file for complete search history.

(56) References Cited

U.S. PATENT DOCUMENTS

| | | | | |
|---|---|---|---|---|
| 270,270 | A * | 1/1883 | Wilbourn | 54/44.1 |
| 497,665 | A * | 5/1893 | Hotze | 54/44.1 |
| 542,940 | A * | 7/1895 | Padgitt | 54/44.1 |
| 821,135 | A * | 5/1906 | Szameitat | 54/44.1 |
| 4,004,402 | A | 1/1977 | Bischeltsreider | |
| 4,965,988 | A | 10/1990 | Anderson | |
| 5,191,752 | A | 3/1993 | Murphy | |
| 5,343,674 | A | 9/1994 | Brown | |
| 5,435,116 | A | 7/1995 | Brown | |
| 5,517,808 | A | 5/1996 | Schleese | |
| 6,223,509 | B1 | 5/2001 | Girault | |
| 6,363,698 | B1 | 4/2002 | Swain | |

FOREIGN PATENT DOCUMENTS

| | | | |
|---|---|---|---|
| FR | 2195972 A | * | 3/1974 |
| FR | 2597463 A1 | * | 10/1987 |
| WO | WO 98/06662 | * | 2/1998 |

* cited by examiner

*Primary Examiner*—Son T. Nguyen

(57) ABSTRACT

An exercise saddle tree and method of construction that utilizes the inherent strength characteristics, defined by wood grain, growth rings, and wood type, of natural wood to create a stronger, low-weight saddle tree design. In addition, the present invention alters a standard saddle tree design and form to distribute the concussive force of horse and rider in a more uniform manner across the structure of the saddle tree.

8 Claims, 6 Drawing Sheets

SADDLE TREE AND METHOD OF CONSTRUCTION FOR EXERCISE SADDLE

BACKGROUND OF THE INVENTION

1. Field of the Invention

The present invention relates to saddle trees, which are frames used in horse saddles to provide strength and shape.

2. Description of the Related Art

A saddle for a horse is typically constructed using a saddle tree, which is generally overlayed with leather to form the seat and other structures of the saddle. Conventionally, saddle trees have been constructed of wood or of wood and metal, such as steel or iron. Within the last several decades, there has been an increasing use of composite materials, such as disclosed in U.S. Pat. No. 5,435,116 (Brown) and U.S. Pat. No. 4,965,988 (Anderson).

The use of new materials was spurred by several important saddle tree design considerations. First and foremost is the desire for a durable saddle tree. Saddles and saddle trees are subjected to repetitive impacts as the rider's body "bounces" on the back of the horse. This impact stress is particularly acute in exercise saddles because a race horse is exercised at a faster gate than a range or trail horse. Eventually, these stresses at the flexure points cause an irreparable fracture of the saddle tree. The relatively short life span of a saddle tree, therefore, is due mainly to the stresses upon certain of its flexible members. To combat these flexure stresses, wooden saddle trees are typically carved from a single piece of wood.

A second important design characteristic is for a flexible saddle tree. While many saddle tree designs incorporate rigid metal components to address the durability issue, such as disclosed in U.S. Pat. No. 6,363,698 (Swain), these designs typically lack flexibility. This can result in injury to either horse or rider. In addition, these metal designs tend to be more malleable than wooden designs, that is they have a tendency to become misshapen from the repeated pounding exerted on saddles due to the concussion between the rider's body and the horse's body.

In the past, saddle tree manufacturers have made use of composite materials, such as thermoplastic or rubber to provide a durable, flexible, and nonmalleable design. Many of these designs have met with limited success and still suffer from the problem of breakage associated with conventional designs.

The present invention is a saddle tree for use with an exercise saddle. An exercise saddle is used to exercise race horses and should mimic a racing saddle in terms of the positioning and weight of the rider on the horse. Whereas a racing saddle typically does not incorporate a saddle tree, an exercise saddle, which is used for much longer periods of time than a racing saddle, needs to incorporate a saddle tree that provide adequate support to prevent injury to the rider. Therefore, a saddle tree for an exercise saddle needs to incorporate the durability, flexibility, and nonmalleability of a standard riding saddle, but must do so in a lightweight form. Such a design is disclosed in U.S. Pat. No. 4,965,988 (Anderson) using thermoplastic materials; however, in practice, the saddle trees using composite materials suffer from breakage to as great an extent as do wood or wood-metal designs. Therefore, the focus of the current invention is to incorporate these four design considerations (weight, durability, flexibility, and non-malleability) into a saddle tree for use in a better-engineered, wooden saddle tree.

BRIEF SUMMARY OF THE INVENTION

The current invention focuses on designing a lightweight saddle tree for use with exercise saddles that blends the design considerations of flexibility, durability, and non-malleability in a light-weight form. As such, the invention uses wood as the material of choice because it is durable and does not tend to become misshapen. However, rather than forming the tree from a single piece of wood, the tree is comprised of three components. The first is an arched pommel portion that fits securely over the withers of a horse. The other two pieces are symmetrical arms which extend towards the horse's flank. The extending arms are connected to the pommel portion by way of a tenon-and-mortise joint and are oriented in a manner to best distribute the force of the rider downward through the saddle tree to the back of the horse. By orienting the grain of the extending arms perpendicularly to the grain of the pommel portion, the saddle tree has added flexibility not available in one-piece wooden saddle trees.

DETAILED DESCRIPTION OF THE INVENTION

Figure 1:
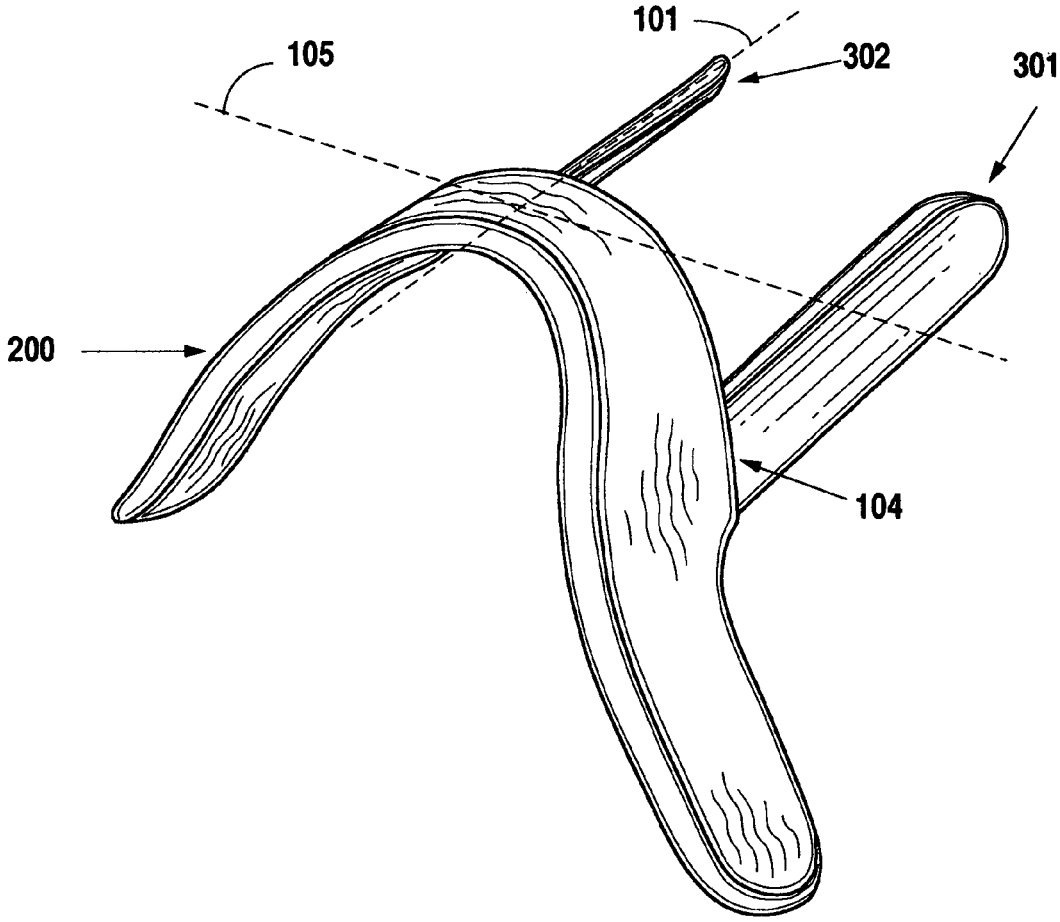
FIG. 1 is a three-dimensional view of the exercise saddle tree of the current invention.

As depicted in FIG. 1, the exercise saddle tree is comprised of three separate components, pommel portion 200 and extending arms 301 and 302, which connect to the pommel portion at joint 104. The extending arms will be mirror images of one another and therefore this description will discuss the extending arms and the related features in the singular. For the purpose of describing the invention lateral axis 101 runs down the spine of the horse from the head to the rear of the horse. Horizontal axis 105 runs approximately across the shoulders or withers of the horse. The lateral plane is the plane running through the lateral axis that is parallel to the ground, which is further assumed to be level. The vertical plane is the plane running through the lateral axis that is perpendicular to the ground.

Figure 2A:
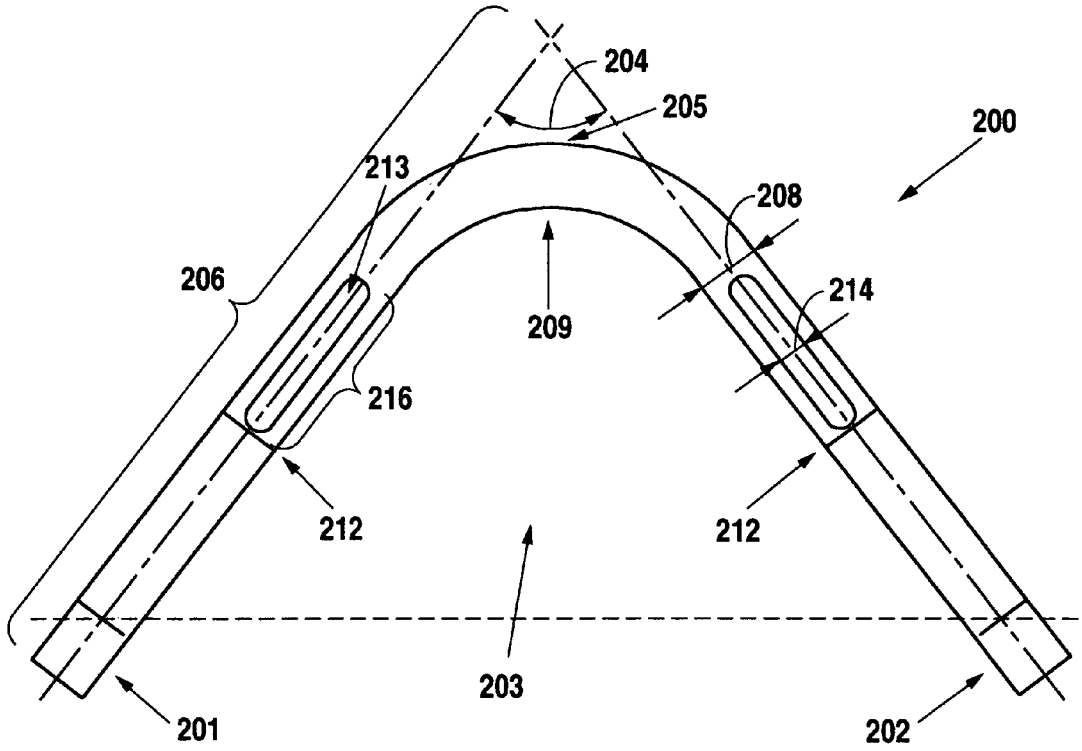
FIG. 2A is the back view of the pommel portion of the exercise saddle tree.
Figure 2B:
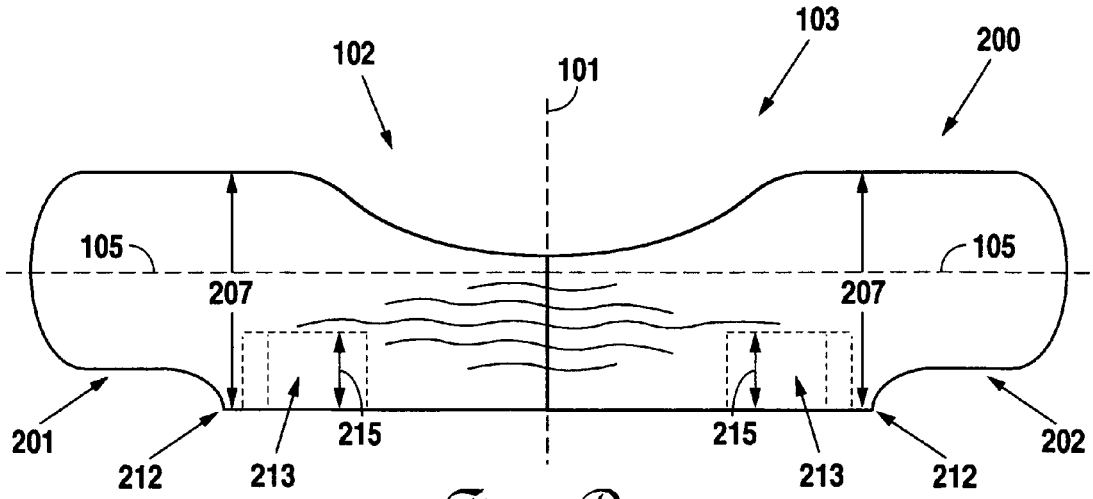
FIG. 2B is the top view of the pommel portion.
Figure 2C:
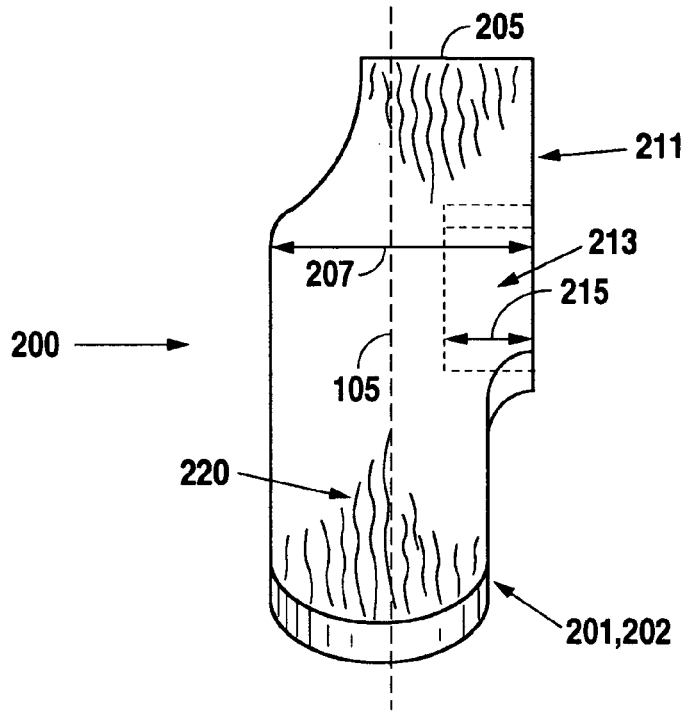
FIG. 2C is the side view of the pommel portion.

FIG. 2A, FIG. 2B, and FIG. 2C are the back, side, and top view, respectively, of pommel portion 200. The pommel portion is a symmetrical, U-shaped arch dimensioned to fit over the withers of a horse. The pommel portion will be centered approximately over lateral axis 101 (FIG. 2B). As shown in FIG. 2A, legs 201 and 202 form the two equal sides of isosceles triangle 203, where apex angle 204 is positioned above rounded edge 205 of the pommel portion. Apex angle 204 will vary depending on the width required of the saddle. Each leg 201 and 202 of the arch is of a sufficient length 206 to extend downward on the withers/shoulders of the horse to a point where the pommel does not rock back and forth across the withers. In the claims, length L refers to length 206.

The pommel portion will have a maximum width 207 (FIGS. 2B and 2C) and depth 208 (FIG. 2A). In the claims, width E refers to width 207. The pommel will have this maximum width and depth on the uppermost part of arch 209 (FIG. 2A) and on the upper part of each leg. The width and depth will taper slightly on the lower part of each leg. On rearward-facing side 211 (FIG. 2C) of each of the legs of the pommel portion, above point 212 (FIGS. 2A and 2B), where the leg begins to taper, is mortise 213 into which tenon 306 (FIGS. 3B, 4A, and 4B) of extending arm 301 will be fitted. Mortise 213 will be of depth 214 (FIG. 2A) that is slightly greater than one-third of depth 208 (FIG. 2A) of the pommel portion. Mortise 213 will have width 215 (FIGS. 2B and 2C) which must be less than or equal to width 207 of the pommel portion. Length 216 (FIG. 2A) of mortise 213 will be slightly greater than width 305 (FIG. 3A) of tenon 306, thus allowing, as depicted in FIG. 4A, tenon 306 to fit snugly into mortise 213. In the claims, width W refers to width 305.

Figure 3A:
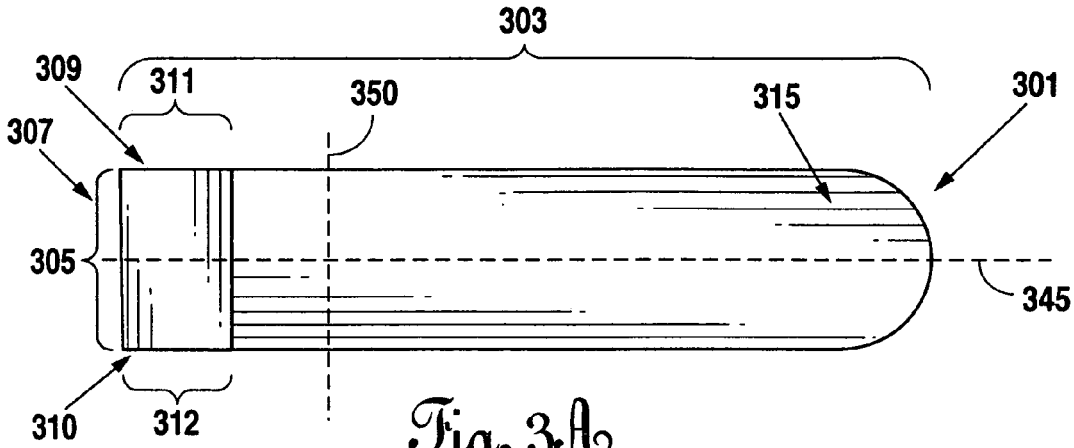
FIG. 3A is the top view of an extending arm of the exercise saddle tree.
Figure 3B:
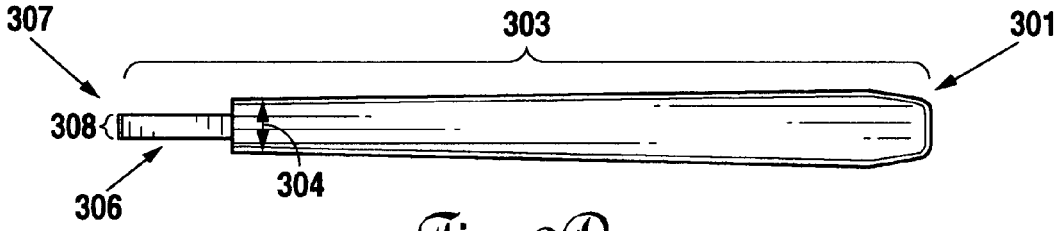
FIG. 3B is the side view of an extending arm.
Figure 4A:
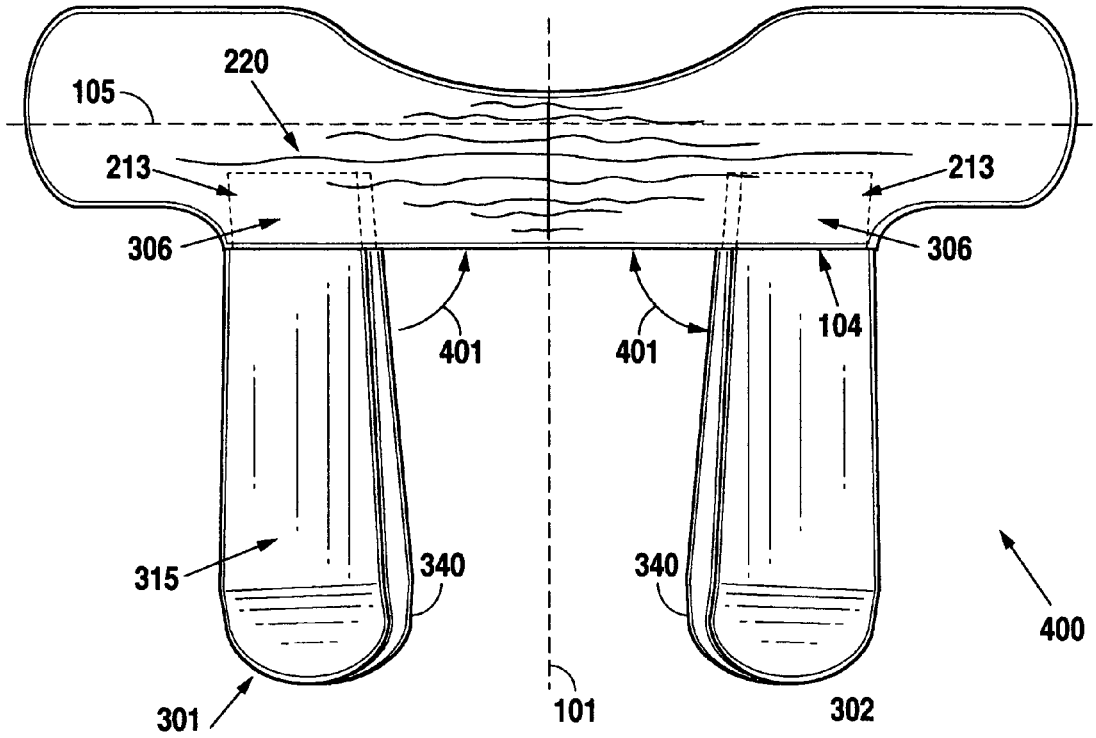
FIG. 4A is the top view of the assembled exercise saddle tree.

FIGS. 3A and 3B show the top and side views, respectively, of left-side extending arm 301. The extending arm is of length 303 that is significantly less than length 206 (FIG. 2A) of the leg of the pommel portion. In the claims, length X refers to length 303. The reasons for specific limitations on the length of the extending arm are described more fully below.

The extending arm will have a maximum depth 304 (FIG. 3B) that is equal to depth 208 (FIG. 2A), thereby allowing extending arm 301 and pommel portion 200 to have a smooth surface at joint 104, as shown in FIG. 4A. In the claims, depth D refers to depth 304. Head end 307 (FIG. 3B) of the extending arm will be tenon 306 (FIG. 3B) that connects (as depicted in FIG. 4A) to mortise 213. To ensure a snug fit, the maximum width 305 (FIG. 3A) and maximum depth 308 (FIG. 3B) of tenon 306 will be slightly less than length 216 (FIG. 2A) and depth 214 (FIG. 2A), respectively, of mortise 213. In the claims, depth G refers to depth 308. As shown in FIG. 3A, the tenon will have inside edge 309 and outside edge 310. Inside edge 309 will be the edge closer to apex rounded edge 205 (FIG. 2A) of the arch of the pommel portion when tenon 306 is inserted into mortise 213. As shown in FIG. 3A, length 311 of inside edge 309 is slightly shorter than length 312 of outside edge 310. In the claims, length A refers to length 311 and length B refers to length 312. This will cause inside angle 401 of joint 104 to be slightly less than 90°, as depicted in FIG. 4A, thereby causing the tail end of the extending arm to rest on the horse's back closer to the animal's spine. This orientation will distribute the rider's weight in a manner to decrease the resultant stresses on the saddle tree.

Figure 2D:
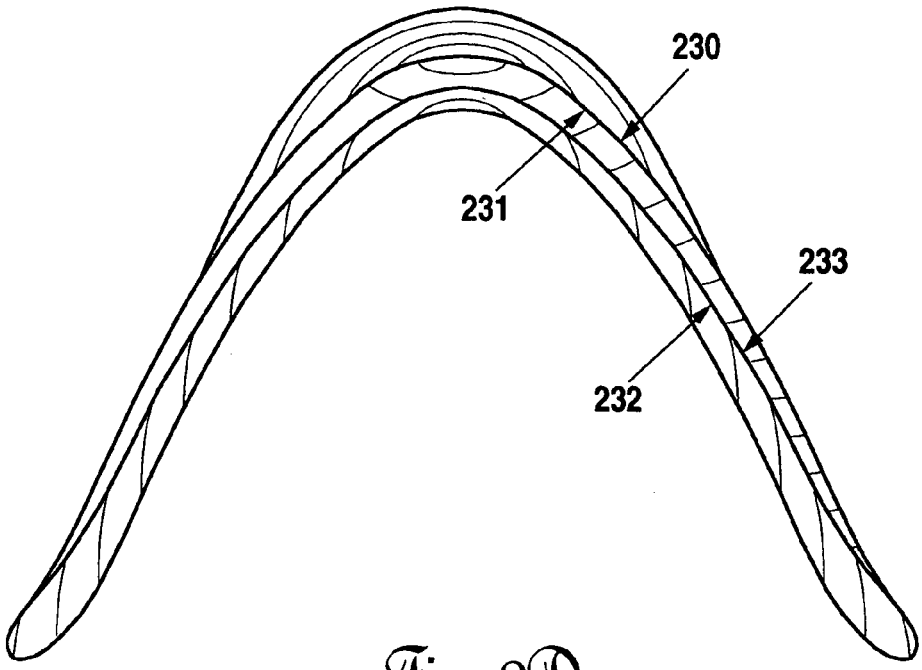
FIG. 2D is a cross-sectional view of the pommel portion.

The pommel portion, shown in FIG. 2D, is comprised of seven separate pieces of wood which are laminated together. A piece of wood exhibits a grain (the arrangement of its wood fibers along the vertical growth direction of a tree) and circular growth rings. Grain 220 (FIG. 2C) of these seven pieces of wood will run in the direction of horizontal axis 105 and down the legs of the pommel portion. To achieve the arched form of the pommel the individual boards will be bent, or curved, before being glued together. To give the combined pieces of wood the greatest strength, the growth rings of the middle piece of wood will be oriented in the opposite direction from the outer pieces of wood. Said otherwise, board edges 230 that are toward the interior of a tree should abut against board edges 231 that are toward the interior of the tree and board edges 232 that are toward the exterior of a tree should abut against board edges 233 that are toward the exterior of the tree.

Figure 3C:
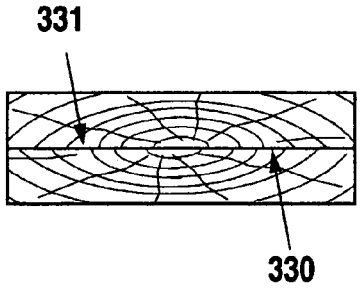
FIG. 3C is a partial cross-sectional view of an extending arm.

The extending arm is comprised of seven separate pieces of wood laminated together. Grain 315 (FIG. 3A) of all seven pieces runs down lateral axis 101 of the saddle. The wood grain of each piece of wood is oriented such that it does not align with the grains of the pieces to which it is laminated, as depicted in FIG. 3C, which shows such orientation for two abutting pieces of wood. Said otherwise, board edges 330 and 331 are oriented so that the grain of each does not realign as if to reform the growth rings of the original wood.

Figure 4B:
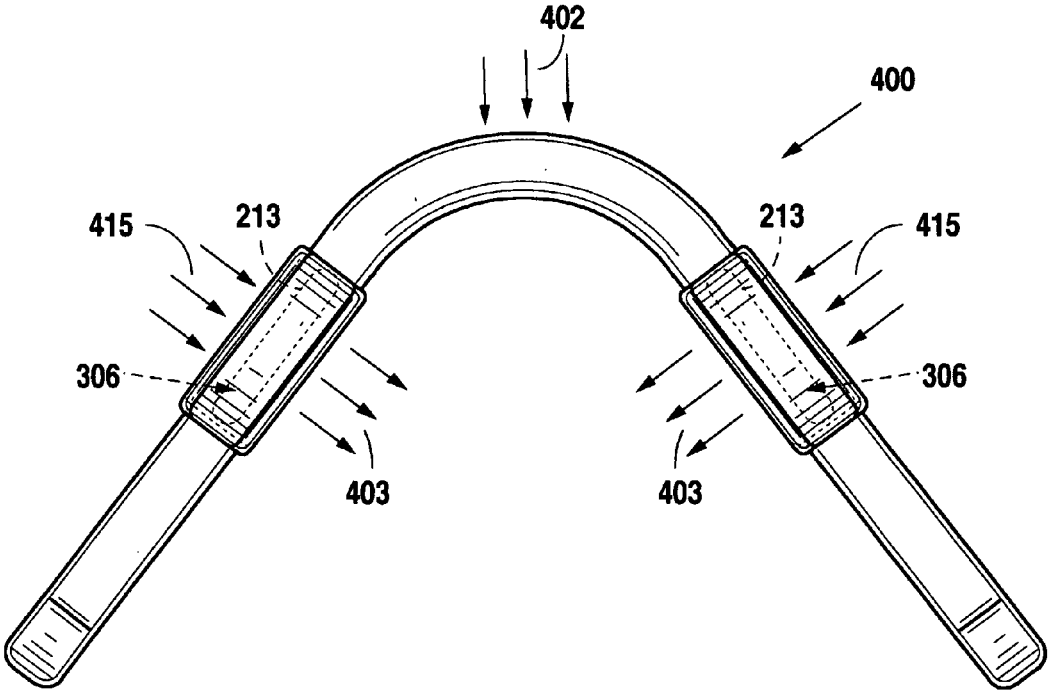
FIG. 4B is the back view of the assembled exercise saddle tree.
Figure 4C:
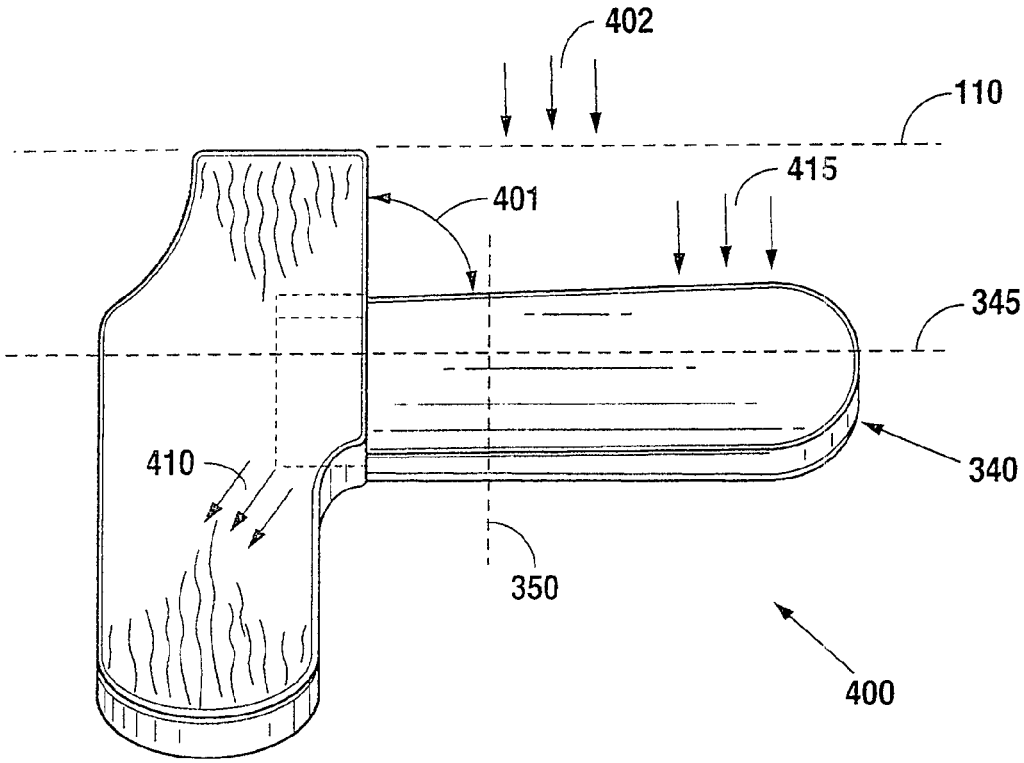
FIG. 4C is the side view of the assembled exercise saddle tree.

FIGS. 4A, 4B, and 4C show the top, back, and side views, respectively, of assembled saddle tree 400. Tenon 306 (FIG. 4A) of an extending arm will be inserted into mortis 213 (FIG. 4A) of the pommel portion. The extending arms will angle slightly inward (see FIG. 4A) along lateral axis 101 and slightly upward (see FIG. 4C) in relation to lateral plane 110. Grain 315 (FIG. 4A) of the extending arm will run along lateral axis 101 and roughly perpendicular to grain 220 (FIG. 4A) of the pommel portion.

Figure 5:
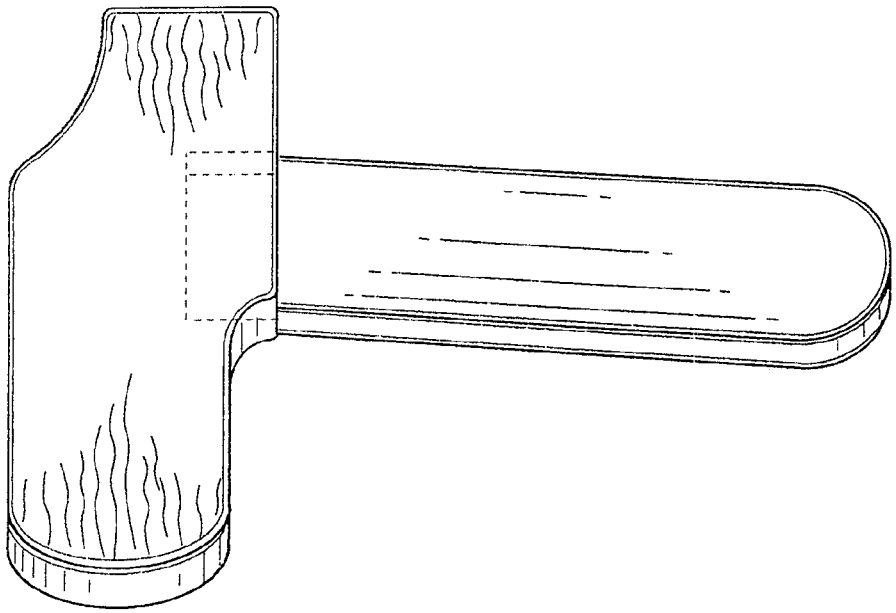
FIG. 5 is the side view of a prior art exercise saddle tree.

FIG. 5 shows an example of a prior art saddle tree. This figure is not intended to encompass all previous prior art saddle trees. These views will be used merely to demonstrate the effect of the design decisions of the saddle tree encompassed within the present invention. Notably, the extending arms of FIG. 5 are longer than the legs of the pommel portion. In addition, the extending arms are angled slightly downward from the horizontal plane. These characteristics are present in a great many prior art saddle trees.

As shown in FIGS. 4B and 4C, the weight of the rider will exert a downward force 402 on the extending arms which exerts pressure 415 at all points along the extending arms. This downward force will dissipate in three manners. First, some of the force will result in bending 403 (FIG. 4B) of the midspan of the extending arms toward the horse's back. Second, some of the force will be transferred to tail end 340 (FIG. 4C) of the extending arms. Third, some of the force will be transferred to the pommel portion by way of joint 104 (FIG. 4A). This force will be exerted along vector 410 (FIG. 4C) that is comprised of a directional component and a magnitude component. These directional and magnitudinal components will vary with the amount of bending 403 (FIG. 4B) of the extending arms and placement of the joint in relation to the rider and the pommel portion. Saddle trees show the greatest tendency to break in midspan, due to the bending of the extending arms, and at the joint, due to the magnitude and direction of forces exerted on the joint by the rider. Therefore, the strength of the joint and its spatial relation to the rider and the pommel portion becomes more critical to preventing breakage.

Many saddle trees incorporate steel to fortify against this breakage, but the addition of steel drastically increases the weight of the tree. The present invention strengthens the saddle primarily by laminating the pieces of wood that are used to build the tree and by incorporates several design choices. First, primarily as a mechanism to reduce the chance of the wood of the extending arms splitting, the grain of the extending arm runs along lateral axis 345 of the extending arm, rather than along tangential axis 350 of the extending arm (FIG. 4C). In those prior art saddle trees that are carved from a single piece of wood, the grain all runs in one direction. In a single-piece construction where the grain runs along the lateral axis, the grain on the pommel portion would run along the width, rather than along the length of the pommel portion, thus weakening of the pommel portion. Apart from breakage in the midspan of the extending leg and at the joint, splitting of the pommel portion along the direction of the horse's spine is one of the largest causes of failure of a saddle tree. The present invention combats this pommel-splitting problem by running the grain across lateral axis 105 on the pommel portion to reduce the likelihood of splitting or breakage of the pommel portion.

A second design choice incorporated in the present invention to fortify against greater bending tendency and altered force vector 410 exerted on the joint involves the placement of joint 104 (FIG. 4A) on the pommel portion. The joint is located slightly lower on the pommel portion. As the joint is moved lower on the pommel portion, angle 401 (FIGS. 4A and 4C) of the joint in relation to the lateral plane is decreased. Therefore, a greater amount of the force is exerted on tangential axis 350 (FIG. 4C) and less is exerted on lateral axis 345 (FIG. 4C) of the extending arm. Tangential axis 350 has a greater ability to absorb the stress applied by this force and therefore the possibility of splitting is further reduce.

A third design choice incorporated in the present invention involves the angling of the extending arms in relation to the lateral plane. The extending arms are angled slightly upward in relation to lateral plane 110 (depicted in FIG. 4C), creating angle 401, that is less than 90°. This again alters force vector 410. Compared to a design in which the extending arms are parallel to the lateral and vertical axes, a greater amount of force is exerted on outside edge 310 (FIG. 3A) of tenon 306. Again this force is exerted on tangential axis 350 (FIG. 4C) of the extending arm, which has a greater ability to absorb stresses.

A fourth design choice involves the dimensions and composition of tenon 306 of the extending arms. First, as depicted in FIG. 3A, outside edge 310 of the tenon, which will be absorbing a greater amount of stress, is slightly longer than inside edge 309, thereby increasing its ability to absorb stresses. Secondly, as depicted in FIG. 3C, the growth rings of the pieces of wood comprising the extending arm are aligned such that the board edges 330 that are toward the interior of a tree should abut against board edges 331 that are toward the interior of the tree. The tenon, which is situated depthwise in the center of the extending arm, will incorporate both pieces of wood and will therefore be similarly strengthened.

A fifth design choice involves the choice of wood used to build the saddle tree. The invention uses wood with a greater ability to absorb tangential forces. One such wood is red oak, but other wood types with a higher relative ability to absorb tangential forces may also be used, depending on availability and price.

The construction of the saddle tree comprises several steps. First, the pieces of wood for each of the three component pieces are chosen, planed to appropriate dimensions, aligned (as described above), bent (in the case of the pommel portion), glued, and clamped. After drying, the rough form, with squared edges, of the pommel portion and each extending arm is cut from the combined pieces of wood. Third, the mortise and tenon portions are cut on the pommel and extending arms, respectively. Next, the tenons on the extending arms are glued into the mortises on the pommel portion. After the assembled tree is given sufficient time to dry, the pommel legs and extending arms are tapered appropriately. Finally, additional hardward, such as stirrup locks, are connected as needed. All of the above operations can either be performed by hand, can be accomplished with numerically-controlled woodworking equipment, or can be achieved with any combination of available woodworking technologies and tools available.

Thus has been described an exercise saddle tree and the method of manufacturing such a saddle tree. Although the description above contains examples of specific embodiments of the invention, these descriptions are provided for illustrative purposes only and are not meant to limit the scope of the invention. The scope of the invention should be limited only by the appended claims and their equivalents.

We claim:

1. A saddle tree to be used in an exercise saddle comprising:

a pommel portion made of wood dimensioned to fit over the withers of a horse wherein the wood grain of the pommel portion is aligned substantially perpendicular to a lateral axis extending roughly along the spine of the horse; and two extending arms made of wood, each connected at a joint on the pommel, and extending from the pommel portion toward the rear of the horse, wherein the extending arms will lie on the back of a horse approximately parallel to the lateral axis and wherein the wood grain of each extending arm is approximately parallel to the lateral axis.

2. A saddle tree of claim 1 wherein the pommel portion comprises two legs, each leg forming one of the two equal sides of an isosceles triangle each side and having length L;

the pommel portion at the apex of the isosceles triangle is rounded; and each extending arm has length X, which is less than or equal to L.

3. A saddle tree of claim 2 wherein each extending arm comprises a head end fixedly connected to the pommel portion and a tail end;

each extending arm has a width W and a depth D;

each extending arm has a tenon extending perpendicularly from the head end of the arm wherein the tenon has a width W and a depth G, wherein G is approximately one-third of D;

each side of the pommel portion has a mortise opening on the face of the pommel facing the rear of the horse, the mortise running a distance of slightly greater than W along a line parallel to the side of the pommel portion and the mortise having a width slightly greater than G.

4. A saddle tree of claim 3 wherein the length of the tenon is not constant;

the length of the tenon at the end furthest from the apex of the isosceles triangle is B;

the length of the tenon decreases at an approximately constant rate along its width until it reaches a minimum, A, at the end nearest the apex of the isosceles triangle;

the pommel portion has a width E, which is between two and three times as large as B; and the width E of the pommel portion is between three and four times as large as A.

5. A method of constructing a saddle tree to be used in an exercise saddle comprising the steps of:

constructing a pommel portion made of wood dimensioned to fit over the withers of a horse and aligning the wood grain of the pommel portion substantially perpendicular to a lateral axis extending roughly along the spine of the horse; and connecting two extending arms made of wood at spaced joints on the pommel, and extending from the pommel portion toward the rear of the horse, wherein the extending arms will lie on the back of a horse approximately parallel to the lateral axis and wherein the wood grain of each extending arm is approximately parallel to the lateral axis.

6. A saddle tree method of claim 5 further comprising the steps of:

the step of constructing the pommel portion comprises forming two legs, each leg forming one of the two equal sides of an isosceles triangle each side and having length L;

rounding the pommel portion at the apex of the isosceles triangle; and constructing each extending arm having length X, which is less than or equal to L.

7. A saddle tree method of claim 6 further comprising the steps of:

attaching each extending arm with a head end fixedly connected to the pommel portion and a tail end with each extending arm has a width W and a depth D;

constructing each extending arm with a tenon extending perpendicularly from the head end of the arm wherein the tenon has a width W and a depth G, wherein G is approximately one-third of D;

constructing each side of the pommel portion with a mortise opening on the face of the pommel facing the rear of the horse, the mortise running a distance of slightly greater than W along a line parallel to the side of the pommel portion and the mortise having a width slightly greater than G.

8. A saddle tree method of claim 7 further comprising the steps of constructing the length of the tenon so it is not constant;

constructing the length of the tenon at the end furthest from the apex of the isosceles triangle as B and the length of the tenon so it decreases at an approximately constant rate along its width until it reaches a minimum, A, at the end nearest the apex of the isosceles triangle;

constructing the width E of the pommel portion so it is between two and three times as large as B; and the width E of the pommel portion is between three and four times as large as A.

* * * * *